US005772063A

United States Patent [19]

Gantz-Bloome

[11] Patent Number: 5,772,063

[45] Date of Patent: Jun. 30, 1998

[54] WASTE RECEPTACLE WITH CHANGEABLE ART DISPLAY CAPABILITY

[76] Inventor: Sharon Gantz-Bloome, 4751 W. Ruffner St., Seattle, Wash. 98199

[21] Appl. No.: 629,742

[22] Filed: Apr. 9, 1996

[51] Int. Cl.[6] ..... B65F 1/00; B65F 1/14

[52] U.S. Cl. ..... 220/500; 40/312; 220/524; 220/662; 220/665; 220/908

[58] Field of Search ..... 220/500, 503, 220/524, 662, 663, 665, 908, 909, 334, DIG. 13; 40/306, 307, 312, 313; 229/112; 206/737

[56] References Cited

U.S. PATENT DOCUMENTS

| | | | |
|---|---|---|---|
| 1,108,066 | 8/1914 | Cooke et al. . | |
| 1,130,086 | 3/1915 | Hobbs . | |
| 1,327,778 | 1/1920 | Reichman et al. . | |
| 1,364,209 | 1/1921 | Richardson . | |
| 1,380,252 | 5/1921 | Richardson et al. . | |
| 1,424,520 | 8/1922 | Richardson et al. . | |
| 1,511,982 | 10/1924 | Schilling | 40/306 X |
| 1,622,210 | 3/1927 | Rystedt | 40/306 X |
| 3,793,756 | 2/1974 | Kay et al. | 40/306 |
| 3,803,738 | 4/1974 | Weiss | 40/306 |
| 3,866,824 | 2/1975 | Lewis | 40/306 |
| 3,947,985 | 4/1976 | Skrzypezak . | |
| 4,961,514 | 10/1990 | Palmer | 220/908 X |
| 5,123,562 | 6/1992 | Bullard et al. | 220/908 X |
| 5,183,175 | 2/1993 | Brown . | |
| 5,236,612 | 11/1993 | Nederveld | 229/862 |
| 5,358,138 | 10/1994 | Karwoski | 220/908 X |
| 5,419,453 | 5/1995 | Lochridge | 220/908 X |

*Primary Examiner*—Allan N. Shoap
*Assistant Examiner*—Niki M. Kopsidas
*Attorney, Agent, or Firm*—Kolisch, Hartwell, Dickinson, McCormack & Heuser

[57] ABSTRACT

A waste receptacle which features structure that permits changeable installation of display art items, as well as the display of embedded or removable three-dimensional items.

3 Claims, 2 Drawing Sheets

WASTE RECEPTACLE WITH CHANGEABLE ART DISPLAY CAPABILITY

BACKGROUND AND SUMMARY OF THE INVENTION

The present invention relates generally to waste receptacles located in public places. In particular, it relates to such waste receptacles which are specially equipped to handle display artwork. While all sorts of art, including three-dimensional works and art embedded in the material which makes up the sides of such receptacles, can be displayed, a preferred embodiment of the invention is disclosed herein in conjunction with the display of flat art.

In order to encourage the disposal of waste products by the public, waste receptacles usually are distributed in public areas, such as along sidewalks, in parks, shopping malls, etc. Waste receptacles can range from the ordinary to the extraordinary. What is disclosed herein reaches toward the extraordinary in the unique way that it combines promotion of waste disposal with an invitation to explore and experience art.

Thus, the present invention features a waste receptacle that includes the usual container for receiving waste or trash, and a special display structure formed with the container that permits changeable installation of flat display art items.

Accordingly, an important object of the invention is to provide a waste receptacle for use in public places to display flatwork art, such as posters, that easily may be replaced periodically.

These and other objects and advantages of the present invention will be more readily understood after a consideration of the drawings and the detailed description which follows.

DETAILED DESCRIPTION OF THE PREFERRED EMBODIMENT AND BEST MODE FOR CARRYING OUT THE INVENTION

Figure 1:
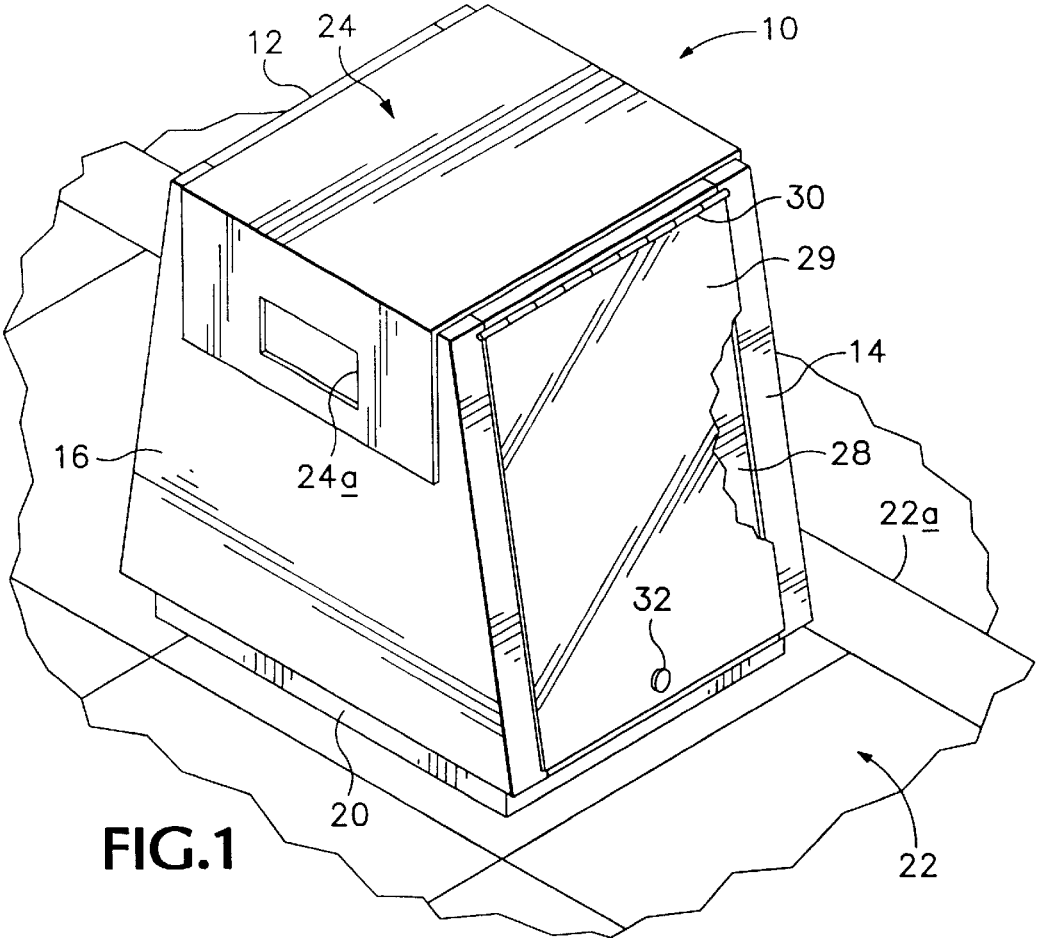
FIG. 1 is a perspective view of a waste receptacle constructed in accordance with a preferred embodiment of the present invention standing in place on a sidewalk.
Figure 2:
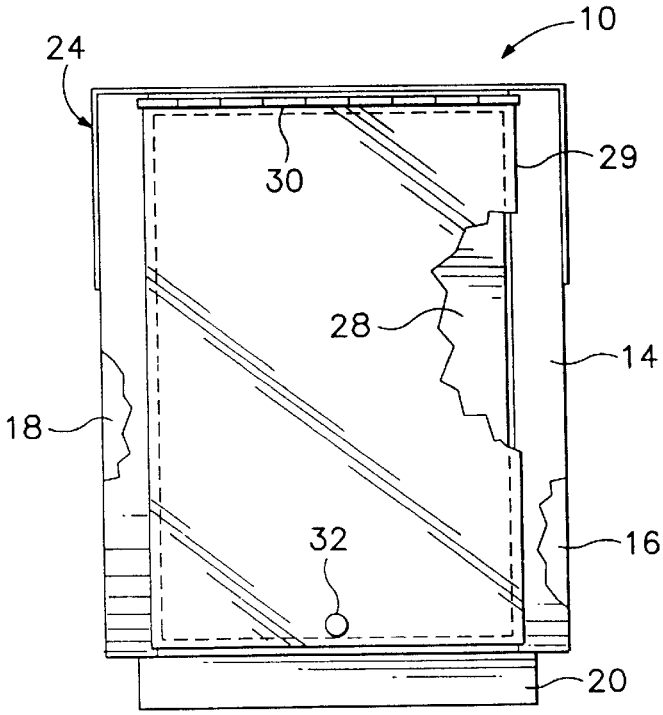
FIG. 2 is a display-side, larger-scale elevational view of the receptacle of FIG. 1.
Figure 3:
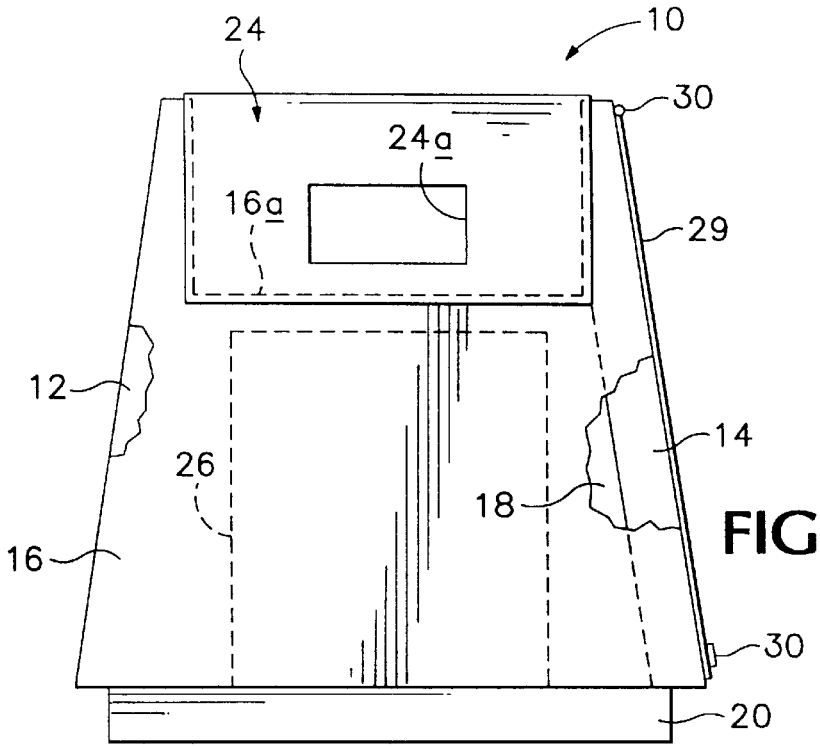
FIG. 3 is a view taken from the right side of FIG. 2.

Turning now to the drawings, and referring first of all to FIGS. 1, 2, and 3, indicated generally at 10 is a waste receptacle constructed in accordance with the present invention. Receptacle 10, as illustrated herein, is formed of four upright suitably prepared concrete slabs 12, 14, 16, 18, which join with a concrete footing 20. In FIG. 1, the receptacle is shown with its footing 20 resting on the street-side edge of a horizontal sidewalk 22. Slabs 12, 14, which define one pair of opposite sides, preferably are inclined at an obtuse angle relative to the horizontal, and in the receptacle now being described, that angle is about 100°. The other two opposing sides 16, 18 are substantially vertical. These sides, as can be seen in FIG. 3, have an upper edge, such as edge 16*a*, which is horizontal and lower than the upper edges of sides 12, 14. Sides 12, 14 also are referred to herein as art-receiving sides, and sides 16, 18 as waste-receiving sides. All sides, of course, could be employed for art display, if desired.

Resting by gravity, and suitably locked into place by a locking mechanism which is not shown, on slabs 12, 14, 16, 18, is a generally U-shaped inverted bonnet 24 formed of a material, such as a suitable metal material, which has sides that drape to merge with the upper edges of sides 16, 18. These sides including rectangular openings, such as the opening shown at 24*a*, allowing the deposition of waste articles into a suitable container, such as that shown in dashed lines at 26 in FIG. 3, which is housed within the hollow interior (chamber) of receptacle 10.

Sides 12, 14 define expanses (display-item structure) for receiving flat display art materials, such as the poster generally shown at 28 in FIG. 2. Such display material rests against the associated slab in the container, and is held thereagainst by a clear, generally matching-perimeter sheet of a plastic material, such as Lexan 29, which is hinged for upward and downward swinging along its upper edge, as indicated by hinge 30. Such sheets/panels are referred to herein also as retaining mechanism. These panels are lockable, adjacent their bases, and a lock (locking mechanism) for panel 29, is shown generally at 32 in FIG. 2. In a modified form of the invention, the bonnet could be employed to lock a panel, such as the Lexan panel, in place.

As pictured in FIG. 1, it is preferable that the receptacle of the invention be positioned in its chosen location in such a fashion that the display material is highly visible to passersby. Accordingly, and in the context of positioning a receptacle such as receptacle 10 on a sidewalk, the inclined, art-containing sides preferably face the opposite directions from which come oncoming pedestrians. In this manner, the receptacle with displayed art becomes an attractive, attention-getting, inviting object. By placing the receptacle in a sidewalk situation adjacent the curb, as is pictured in FIG. 1, people who are responsible for emptying waste material can gain access easily from an adjacent vehicle next to the curb.

Obviously, artwork can be and should be, as desired, replaced at will simply by unlocking the hinged protective viewing panels and sliding the artwork into place. This typically might take the form of sliding such artwork into upper and lower elongate channels that are joined either to the concrete sides of the concrete receptacle, or to the inside face of the Lexan cover sheet. This detail, which is purely a matter of user choice, is not illustrated specifically in the drawings.

Figure 4:
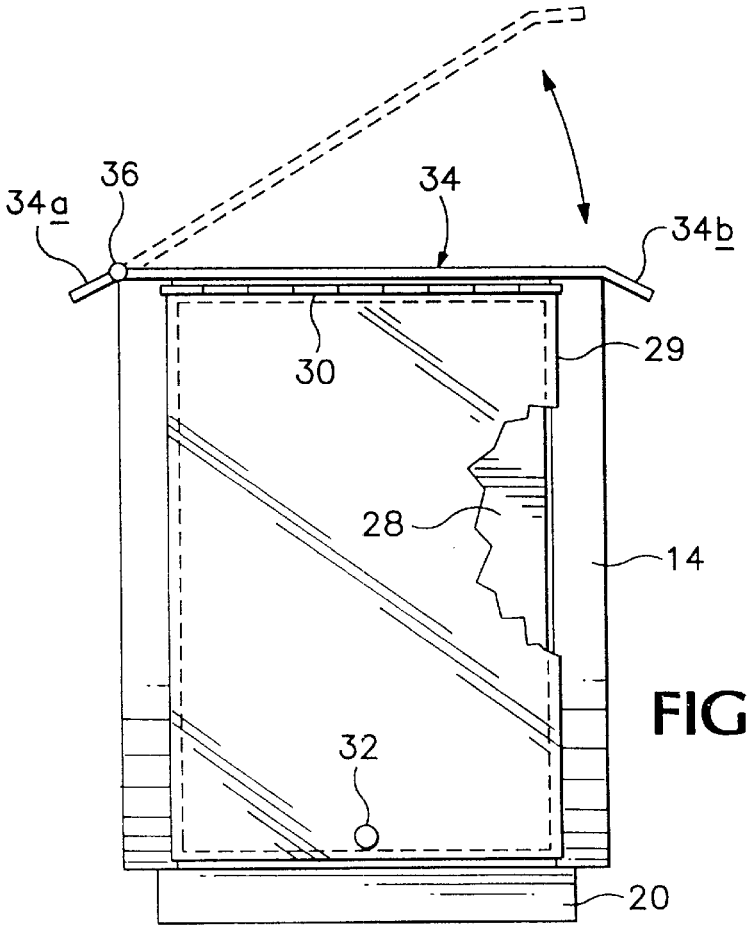
FIG. 4 is a detail of a modified form of the invention viewing the same as in FIG. 2.

In FIG. 4, which offers a view of a modified form of the invention as the same might be looked at from the point on the opposite side of the receptacle relative to that shown in view of FIG. 2, a bonnet 34 is provided, which is swingably hinged by a hinge at one side of the bonnet shown at 36. Dash-dot lines indicate swing motion of the bonnet to open the receptacle for the emptying of collected waste articles. Bonnet 34 includes perimetral-edge flashing stretches such as the two stretches shown at 34*a*, 34*b*, which afford weather protection to the upper perimeter edges of the receptacle, and thus to art-containing spaces.

Referring again to the placement of receptacle 10 as illustrated at curbside in FIG. 1, with the embodiment illustrated in FIG. 4, preferably the same, in a curbside setting, would rest with the hinge on the sidewalk side, so that a person assigned to empty and maintain the receptacle could do so easily from the curb side of the sidewalk. An appropriate lock (not shown) is provided on the non-hinged side of bonnet 34.

It thus should be apparent that what is proposed by the present invention is a very attractive type of public-space waste receptacle which invites attention and use by employing the display of interesting flat artwork, such as posters. It also, therefore, serves as a very convenient and highly trafficked arena for the display of periodically changing art. And, while a generally rectilinear design has been illustrated and described, any shape, such as cylindrical or other, could be used.

As was already mentioned, three-dimensional works could be mounted for display, and materials for display could be embedded permanently, for example, in the concrete which forms the sides of the container.

While a preferred embodiment, and one modification of the invention have been described generally herein, it will be apparent to those who are skilled in this art that variations and modifications may be made without departing from the spirit of the invention.

I claim:

1. A waste receptacle comprising:

a container having a chamber for receiving waste articles, said container having a plurality of laterally adjacent sides including two planar, substantially vertical sides and two planar inclined sides, said plurality of sides being disposed in an alternating vertical-inclined-vertical-inclined arrangement, the container having an opening disposed at an upper portion of the container, said opening allowing access to the chamber, and a display-item structure joined to at least one of said vertical side and said inclined side permitting changeable viewable installation of a display item, with said display item structure including an expanse for receiving such an item, which is a flat item, and wherein the receiving expanse is parallel to said at least one of said vertical side and said inclined side, which expanse extends upwardly from closely adjacent a base of the container substantially along the entire and majority overall height of the container.

2. The receptacle of claim 1, which includes a capping bonnet that has a stretch which extends over and above said structure to afford weather protection.

3. An art-displaying waste receptacle placeable in a location characterized by pedestrian traffic flow along a path, which flow occurs in one of two substantially opposite direction along the path, said receptacle, in operative condition relative to such a path, comprising:

a container including two pairs of spaced, laterally disposed, opposite sides defining a chamber for receiving waste articles, the container including an opening disposed at an upper portion of the container and allowing access to the chamber, said pairs of sides including one pair whose sides occupy generally upright, substantially vertical, spaced, parallel planes generally parallel to such a path and which sides include upper portions affording access for the deposition of waste material within said chamber, and another pair which slope inwardly and upwardly toward one another from adjacent a base of the container in spaced, angled planes which extend transversely in facing relationship relative to such a path, wherein said sides of the said container have an alternating vertical-sloped-vertical-sloped arrangement, and display-item, structure for displaying artwork joined to at least one of said sides and permitting changeable, viewable installation of display art extending parallel to said at least one of said sides and upwardly form adjacent said base.

* * * * *